US007609245B2

(12) United States Patent
Kasai

(10) Patent No.: US 7,609,245 B2
(45) Date of Patent: Oct. 27, 2009

(54) LIQUID CRYSTAL DEVICE, METHOD OF DRIVING THE SAME AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 12/031,291

(22) Filed: Feb. 14, 2008

(65) Prior Publication Data

US 2008/0239179 A1 Oct. 2, 2008

(30) Foreign Application Priority Data

Mar. 27, 2007 (JP) ..... 2007-080863

(51) Int. Cl.
*G09G 3/36* (2006.01)

(52) U.S. Cl. ..... 345/89; 345/98; 345/102

(58) Field of Classification Search ..... 345/87–104
See application file for complete search history.

(56) References Cited

U.S. PATENT DOCUMENTS

2006/0221031 A1* 10/2006 Chang et al. ..... 345/89
2006/0238525 A1* 10/2006 Hong et al. ..... 345/204
2007/0229432 A1* 10/2007 Kimura ..... 345/96

FOREIGN PATENT DOCUMENTS

JP A 2003-202549 7/2003
JP A 2003-279931 10/2003

* cited by examiner

*Primary Examiner*—Jimmy H Nguyen
(74) *Attorney, Agent, or Firm*—Oliff & Berridge, PLC

(57) ABSTRACT

A liquid crystal device that operates in a first operation mode and a second operation mode. The liquid crystal device includes a plurality of scanning lines, a plurality of data lines, a plurality of pixel circuits, a scanning line driving device, and a data line driving device. The plurality of pixel circuits are provided at positions corresponding to intersections of the scanning line and the data lines. Each of the plurality of pixel circuits includes a liquid crystal element that has a first electrode, a second electrode, and a liquid crystal held between the first electrode and the second electrode. A first alignment, which is an initial state, and a second alignment for display are provided for the liquid crystal as an alignment state. The scanning line driving device selects the plurality of scanning lines in a predetermined order. The data line driving device supplies each of the pixel circuits corresponding to the selected one of scanning lines with a writing voltage through the corresponding data line. In the first operation mode, in one frame that includes a first period and a second period, the data line driving device outputs a gray-scale voltage corresponding to a gray-scale to be displayed as the writing voltage in the first period and outputs a first voltage, which is used for maintaining the second alignment, as the writing voltage to the data line in the second period. In the second operation mode, the data line driving device outputs a second voltage, which is used for maintaining the second alignment, as the writing voltage in all the period of the one frame. The second voltage is higher than the first voltage.

10 Claims, 10 Drawing Sheets

LIQUID CRYSTAL DEVICE, METHOD OF DRIVING THE SAME AND ELECTRONIC APPARATUS

BACKGROUND

1. Technical Field

The present invention relates to a liquid crystal device that uses a liquid crystal with bend alignment and splay alignment as an alignment state, a method of driving the liquid crystal device and an electronic apparatus.

2. Related Art

A liquid crystal device that performs display using a liquid crystal varying its transmittance ratio is widely used as a display device of an electronic apparatus, such as an information processing device, a television, or a cellular phone. In the liquid crystal device, pixel electrodes are formed at positions corresponding to intersections of scanning lines that extend in a row direction and data lines that extend in a column direction. In addition, a pixel switch, such as a thin-film transistor (hereinafter, referred to as TFT, where appropriate), that turns on/off on the basis of a scanning signal supplied to a corresponding one of the scanning lines is provided at each of the intersections and interposed between each of the pixel electrodes and a corresponding one of the data lines. Furthermore, an opposite electrode is provided so as to be opposed to the pixel electrodes via the liquid crystal. An alignment state of the liquid crystal varies on the basis of a voltage applied between the pixel electrodes and the opposite electrode. In this manner, the amount of light transmitted in each of pixels is varied, thus making it possible to perform a predetermined display.

An Optical Compensated Bend (OCB) mode liquid crystal, which has been progressively developed in recent years as a new display mode for a liquid crystal device, has two types of alignment states, that is, a splay alignment and a bend alignment. The bend alignment is suitable for image display and is able to respond at a speed higher than an existing Twisted Nematic (TN) liquid crystal. When an initial state, that is, a state where an applied voltage is 0 V, has been continued for a long time, the OCB liquid crystal is placed in the splay alignment that is not suitable for image display. Therefore, when an image is displayed, it is necessary to perform an initial transition operation when power is on, or the like, to transfer liquid crystal molecules to the bend alignment. The transition from the splay alignment to the bend alignment in the initial transition operation is performed by applying a high voltage for a certain period of time.

Even when the transition from the splay alignment to the bend alignment is once performed through the initial transition operation, if a voltage of a predetermined level or above is not applied for some time, the OCB liquid crystal cannot maintain the bend alignment and returns from the bend alignment to the splay alignment. This phenomenon is called reverse transition. JP-A-2003-279931 (particularly, at paragraph [0016], or the like) describes that, in order to suppress the occurrence of reverse transition, a pulse voltage corresponding to non-image data is applied during one frame period. In a normally white OCB liquid crystal, the state where a pulse voltage is applied corresponds to black display, so that applying a pulse voltage to maintain the bend alignment is also called black insertion. JP-A-2003-279931 also describes that there is a correlation between a pulse voltage value that is applied in black insertion and the effect of maintaining the bend alignment.

In the meantime, in regard to the OCB liquid crystal, JP-A-2003-202549; (particularly, in FIG. 14) describes the voltage-transmittance ratio characteristics of an OCB liquid crystal element. In this voltage-transmittance ratio characteristics, as an applied voltage increases, the transmittance ratio decreases. However, when the voltage exceeds a voltage that corresponds to a so-called black level, the transmittance ratio increases, on the contrary.

As described in JP-A-2003-279931, when black insertion is performed, there is a correlation between the pulse voltage value and the effect of maintaining the bend alignment, and the effect of maintaining the bend alignment is enhanced by inserting a higher voltage pulse. For this reason, in order to improve reliability of maintaining the bend alignment, it is desirable that a voltage as high as possible is applied for black insertion.

On the other hand, when a high voltage that exceeds a black level is applied, the transmittance ratio increases as described in JP-A-2003-202549 and, as a result, light leakage occurs in black insertion. Because this light leakage is originally unnecessary for display, there is a possibility that the display characteristics of the OCB liquid crystal may be adversely affected. Thus, it is not easy to improve reliability of maintaining the bend alignment while avoiding adversely affecting the display characteristics.

SUMMARY

An advantage of some aspects of the invention is to improve reliability of maintaining the bend alignment while avoiding adversely affecting the display characteristics.

An aspect of the invention provides a liquid crystal device that operates in a first operation mode and a second operation mode. The liquid crystal device includes a plurality of scanning lines, a plurality of data lines, a plurality of pixel circuits, a scanning line driving device, and a data line driving device. The plurality of pixel circuits are provided at positions corresponding to intersections of the scanning line and the data lines. Each of the plurality of pixel circuits includes a liquid crystal element that has a first electrode, a second electrode, and a liquid crystal held between the first electrode and the second electrode. A first alignment, which is an initial state, and a second alignment for display are provided for the liquid crystal as an alignment state. The scanning line driving device selects the plurality of scanning lines in a predetermined order. The data line driving device supplies each of the pixel circuits corresponding to the selected one of scanning lines with a writing voltage through the corresponding data line. In the first operation mode, in one frame that includes a first period and a second period, the data line driving device outputs a gray-scale voltage corresponding to a gray-scale to be displayed as the writing voltage in the first period and outputs a first voltage, which is used for maintaining the second alignment, as the writing voltage to the data line in the second period. In the second operation mode, the data line driving device outputs a second voltage, which is used for maintaining the second alignment, as the writing voltage in all the period of the one frame. The second voltage is higher than the first voltage.

According to the above aspect, in the second operation mode, because the second voltage is applied to the liquid crystal element in order to maintain the second alignment, it is possible to immediately shift the mode to the first operation mode. On the other hand, in the first operation mode as well, the first voltage is applied to the liquid crystal element in the second period in order to maintain the second alignment. Here, because the second voltage is larger than the first voltage, it is possible to improve reliability of maintaining the second alignment in the second operation mode.

In addition, a specific embodiment of the liquid crystal may be an OCB (Optical Compensated Bend) mode liquid crystal, wherein the first alignment may be a splay alignment, and wherein the second alignment may be a bend alignment. The OCB liquid crystal has a short response time of transmittance ratio to a voltage applied thereto, so that it is possible to display a high-quality moving image. Moreover, the above described liquid crystal device may further include a backlight that turns on a light in the first operation mode and that turns off a light in the second operation mode. In this case, the liquid crystal device is of a transmissive type; however, because the backlight may be turned off in the second operation mode, it is possible to reduce power consumption in the second operation mode.

In addition, the data line driving device may include a main driving device and an auxiliary driving device, wherein the main driving device supplies the data line with the gray-scale voltage as the writing voltage in the first operation mode, and wherein the auxiliary driving device supplies the data line with the second voltage as the writing voltage in the second operation mode. Alternatively, the data line driving device may include a main driving device and an auxiliary driving device, wherein the main driving device supplies the data line with the gray-scale voltage and the first voltage as the writing voltage in the first operation mode, and wherein the auxiliary driving device supplies the data line with the second voltage as the writing voltage in the second operation mode. Because the second voltage is larger than the first voltage, if the main driving device and the auxiliary driving device are not separated but integrated, it is necessary to select elements that constitute the data line driving device so as to withstand the second voltage. In contrast, according to the aspect of the invention, because the data line driving device is separated into the main driving device and the auxiliary driving device, it is possible to reduce a withstand voltage of elements that constitute the main driving device as compared with a withstand voltage of elements that constitute the auxiliary driving device. As a result, it is possible to reduce the manufacturing cost.

In addition, the main driving device may be configured to stop operating in the second operation mode, in terms of reducing power consumption. Moreover, in the above liquid crystal device, the first operation mode may be a display mode in which an image is displayed, and the second operation mode may be a non-display mode in which no image is displayed. Furthermore, an aspect of the invention provides an electronic apparatus that is provided with the above described liquid crystal device. The above liquid crystal device includes, for example, a personal computer, a cellular phone, and a personal digital assistants.

Another aspect of the invention provides a method of driving a liquid crystal device in a first operation mode and in a second operation mode. The liquid crystal device includes a plurality of scanning lines, a plurality of data lines, and a plurality of pixel circuits. The plurality of pixel circuits are provided at positions corresponding to intersections of the scanning line and the data lines. Each of the plurality of pixel circuits includes a liquid crystal element that has a first electrode, a second electrode, and a liquid crystal held between the first electrode and the second electrode. A first alignment, which is an initial state, and a second alignment for display are provided for the liquid crystal as an alignment state. The method includes selecting the plurality of scanning lines in a predetermined order, supplying each of the pixel circuits corresponding to a selected one of the scanning lines with a writing voltage through the corresponding data line, in the first operation mode, outputting, in one frame that includes a first period and a second period, a gray-scale voltage corresponding to a gray-scale to be displayed as the writing voltage in the first period and outputting a first voltage, which is used for maintaining the second alignment, as the writing voltage to the data line in the second period, in the second operation mode, outputting a second voltage, which is used for maintaining the second alignment, as the writing voltage to the data line in all the period of the one frame, and setting the second voltage to be higher than the first voltage. According to the above aspect, in the second operation mode, because the second voltage is applied to the liquid crystal element in order to maintain the second alignment, it is possible to immediately shift the mode to the first operation mode. On the other hand, in the first operation mode as well, the first voltage is applied to the liquid crystal element in the second period in order to maintain the second alignment. Here, because the second voltage is higher (larger) than the first voltage, it is possible to improve reliability of maintaining the second alignment in the second operation mode. Note that, the first operation mode may be a display mode in which an image is displayed, and the second operation mode may be a non-display mode in which no image is displayed.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Embodiment

Figure 1:
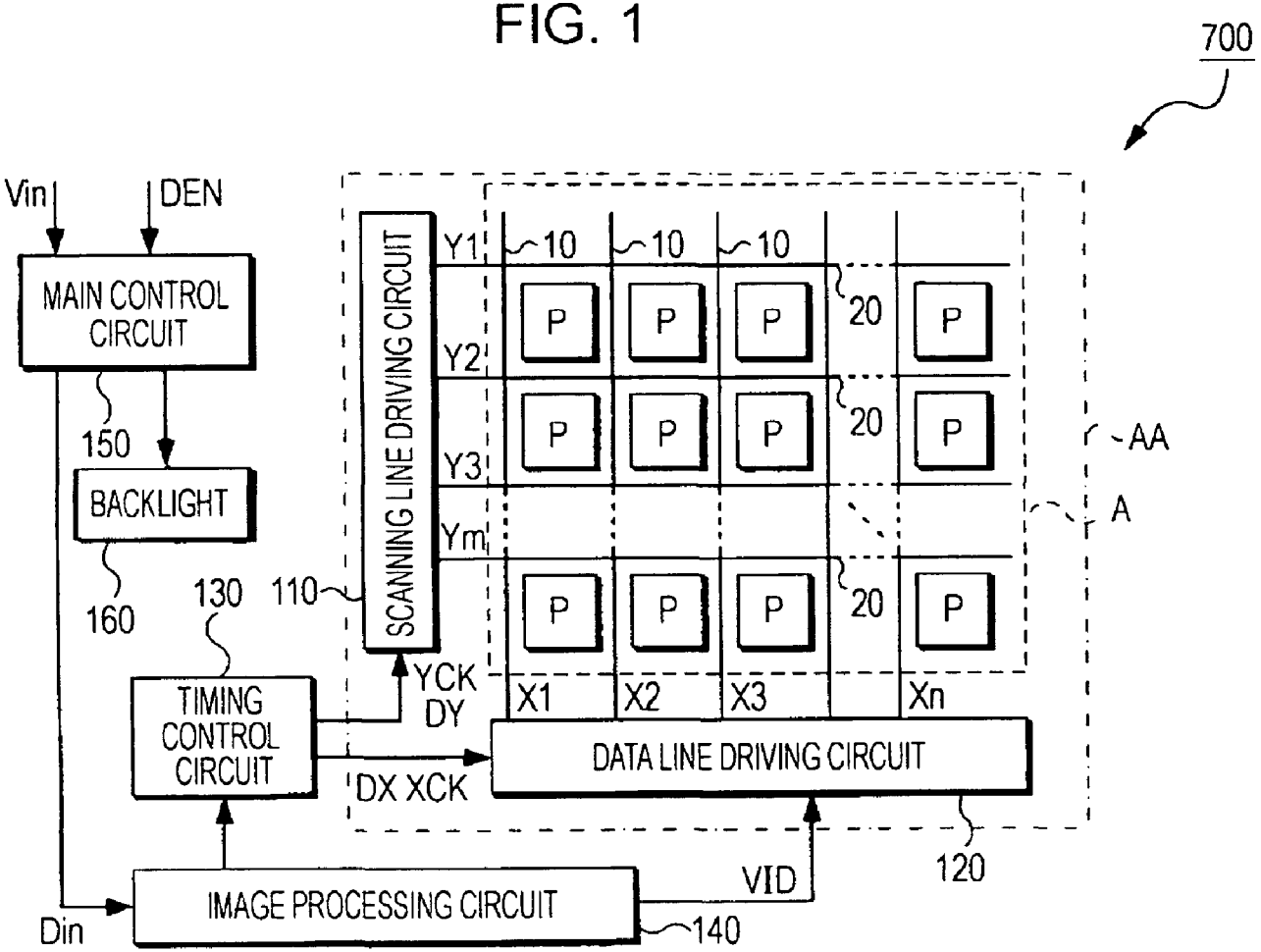
FIG. 1 is a block diagram of a liquid crystal device according to an embodiment of the invention.

FIG. 1 is a block diagram of a liquid crystal device according to an embodiment. The liquid crystal device 700 uses a liquid crystal as an electro-optical material. The liquid crystal device 700 is provided with a liquid crystal panel AA as a main component. The liquid crystal panel AA is configured so that an element substrate, on which TFTs are formed as switching elements, and an opposite substrate are adhered with a constant gap formed therebetween in such a manner that their electrode forming surfaces are opposed to each other, and the liquid crystal is held in the gap. The liquid crystal of this example is an OCB liquid crystal.

In addition, the liquid crystal device 700 includes a timing control circuit 130, an image processing circuit 140, a main control circuit 150 and a backlight 160. On the element substrate of the liquid crystal panel AA, an image display area A, a scanning line driving circuit 110 and a data line driving circuit 120 are formed. The main control circuit 150 converts an input image signal Vin that is supplied from an external device in analog format into a digital signal, and supplies the digital signal to the image processing circuit 140 as input image data Din. In addition, the main control circuit 150 controls lighting of the backlight 160.

The input image data Din supplied from the main control circuit 150 to the image processing circuit 140 are, for example, 24-bit parallel data. The timing control circuit 130, in synchronization with a control signal, such as a horizontal scanning signal or a vertical scanning signal, supplied from the image processing circuit 140, generates a Y clock signal YCK, an X clock signal XCK, a Y transfer start pulse DY, and an X transfer start pulse DX and supplies them to the scanning line driving circuit 110 and the data line driving circuit 120. In addition, the timing control circuit 130 generates and outputs various timing signals that control the image processing circuit 140.

Here, the Y clock signal YCK specifies a period during which a scanning line 20 is selected, and the X clock signal XCK specifies a period during which a data line 10 is selected. These clock signals are generated on the basis of driving frequency, which is a reference of operation of the timing control circuit 130. In addition, the Y transfer start pulse DY is a pulse that specifies a start of selection of the scanning line 20, and the X transfer start pulse DX is a pulse that specifies a start of selection of the data line 10. The image processing circuit 140 performs gamma correction, or the like, in view of light transmission characteristic of the liquid crystal panel AA, on the input image data Din supplied from the main control circuit 150 and, after that, performs D/A conversion on the image data of each of RGB colors to generate an image signal VID, and then supplies the image signal VID to the liquid crystal panel AA.

The liquid crystal device 700 of the present embodiment has a plurality of operation modes. For example, a display mode that performs image display and a non-display mode that interrupts image display may be switched to each other. In general, in an electronic apparatus that uses the liquid crystal device 700 as a display device, the display device is not always held in a display state but often made into a non-display state depending on the situation to reduce power consumption and to prevent degradation of the display device. Here, a driving mode in the display state is termed as a display mode, and a driving mode in a non-display state is termed as a non-display mode. An identification signal DEN that identifies the display mode or the non-display mode is input into the main control circuit 150 from the outside of the liquid crystal device 700. Note that it may be configured so that, not based on the identification signal DEN input from the outside but based on the input image signal Vin, or the like, the main control circuit 150 itself identifies a mode.

Figure 2:
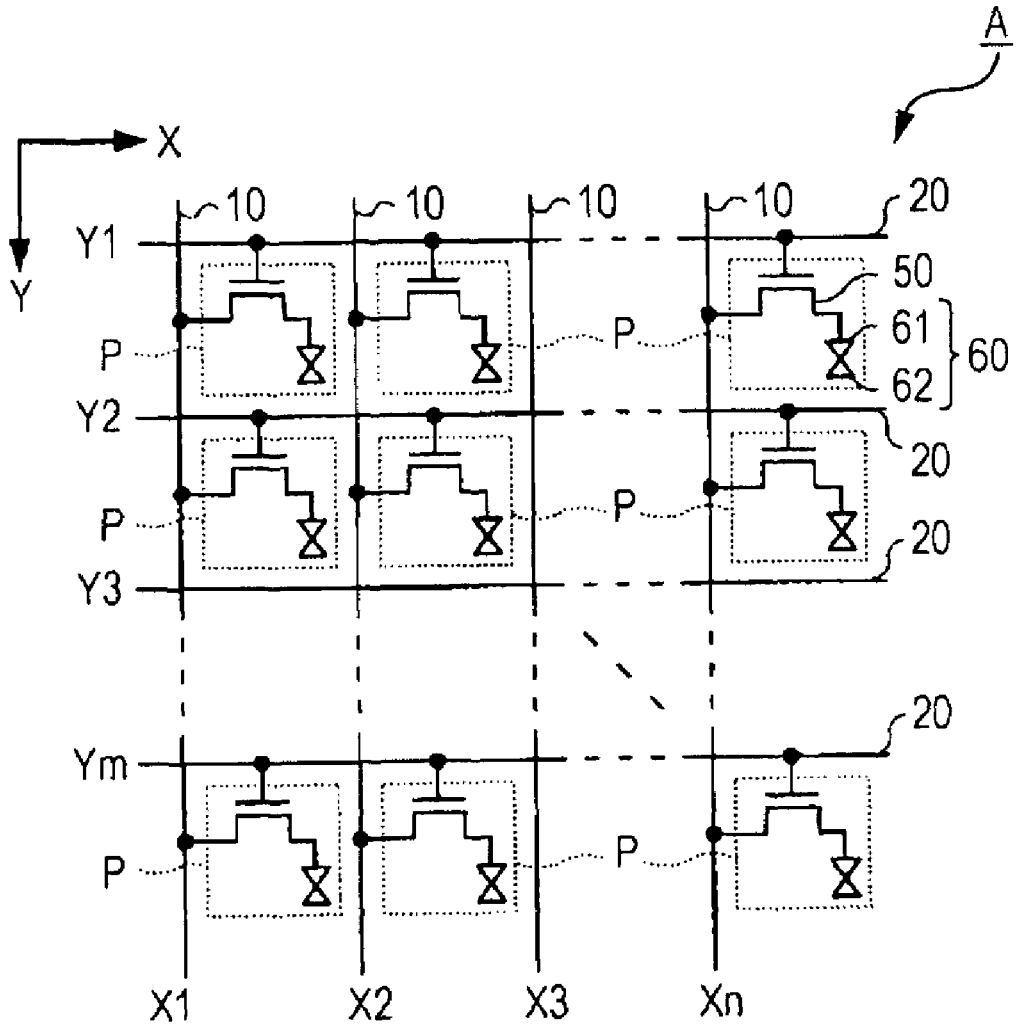
FIG. 2 is a block diagram that shows a detailed configuration of an image display area of the liquid crystal device.

FIG. 2 is a view that shows a detailed configuration of the image display area A. In the image display area A, m (m is natural number equal to or more than one) scanning lines 20 are formed so as to be arranged parallel to an X direction, while n (n is natural number equal to or more than one) data lines 10 are formed so as to be arranged parallel to a Y direction. Then, m×n pixel circuits P are arranged at positions corresponding to intersections of the data lines 10 and the scanning lines 20.

As shown in the drawing, each of the pixel circuits P includes a liquid crystal element 60 and a TFT 50. The liquid crystal element 60 is formed so that an OCB liquid crystal is held between a pixel electrode 61 and an opposite electrode 62. A reference electric potential Vcom is supplied to the opposite electrode 62. The gate electrode of the TFT 50 is electrically connected to the corresponding scanning line 20. One of the drain electrode and the source electrode of the TFT 50 is electrically connected to the corresponding data line 10, and the other is electrically connected to the pixel electrode 61.

The data line driving circuit 120 shown in FIG. 1 includes an operational amplifier, a DA conversion circuit, a level shifter, a gray-scale signal latch, an IF circuit, a shift register, and the like, and outputs data signals X1 to Xn to the n data lines 10. Generally, an alternating current driving method is performed in a liquid crystal device. When the polarity of a signal is defined so that an electric potential higher than the reference electric potential Vcom of the opposite electrode 62 is positive polarity and an electric potential lower than the reference electric potential Vcom is negative polarity, in the present embodiment, a dot inversion driving method that combines a line inversion driving method, by which a voltage applied to a liquid crystal is inverted in units of the scanning line 20 and the data line 10, with a frame inversion driving method by which the voltage applied to the liquid crystal is inverted in units of frame is performed. Note that any one of the line inversion driving method and the frame inversion driving method may be used or another driving method may be used.

The scanning lines 20 are sequentially applied with scanning signals Y1, Y2, . . . , Ym in pulse form from the scanning line driving circuit 110. For this reason, as a scanning line 20 is supplied with a scanning signal, the TFT 50 of each pixel circuit P in that corresponding row enters an on state and then a data signal supplied through the corresponding data line 10 is written to the liquid crystal element 60. Because order and alignment of liquid crystal molecules vary on the basis of a voltage level applied to each pixel, it is possible to perform a grayshade using optical modulation.

For example, the amount of light that passes the liquid crystal is reduced as an applied voltage increases in a normally white mode, while, on the other hand, the amount of light that passes the liquid crystal is increased as an applied voltage increases in a normally black mode. Thus, light that has a contrast corresponding to an image signal is emitted from each of the pixels over the entire liquid crystal device 700. The liquid crystal device 700 of this embodiment is normally white. Therefore, in a state where an applied voltage is high, black is displayed. Note that, in order to prevent leakage of an image signal being held, a holding capacitor may be added in parallel with a liquid crystal capacitor formed between each of the pixel electrodes 61 and the corresponding opposite electrode 62.

In the present embodiment, a voltage for black insertion in the display mode and a voltage for black insertion in the non-display mode are different from each other. The voltage for black insertion in the non-display mode is a voltage of pulse that is applied when no image display is performed by the liquid crystal device 700, and is higher (larger in potential difference) than a voltage of pulse that is applied in the display mode. For this reason, in the present embodiment, the data line driving circuit 120 has a function that is able to change an output range.

A condition to shift from the display mode to the non-display mode may be set to when an operation is not received for a predetermined period of time or the same screen is continuously displayed for a predetermined period of time, when the display face of the liquid crystal device 700 is covered with a cover or is closed, when an instruction to perform a non-display mode is received from a user, or the like. For this reason, the electronic apparatus provided with the liquid crystal device 700 has a detection function, such as a timer or a sensor. On the other hand, a condition to shift from the non-display mode to the display mode may be set to when an operation is received or a screen display is changed, when a cover is removed or opened, when an instruction to perform a display state is received from a user, or the like. Note that, in the non-display mode, it is desirable to turn off the backlight 160 in terms of reducing power consumption.

Figure 3:
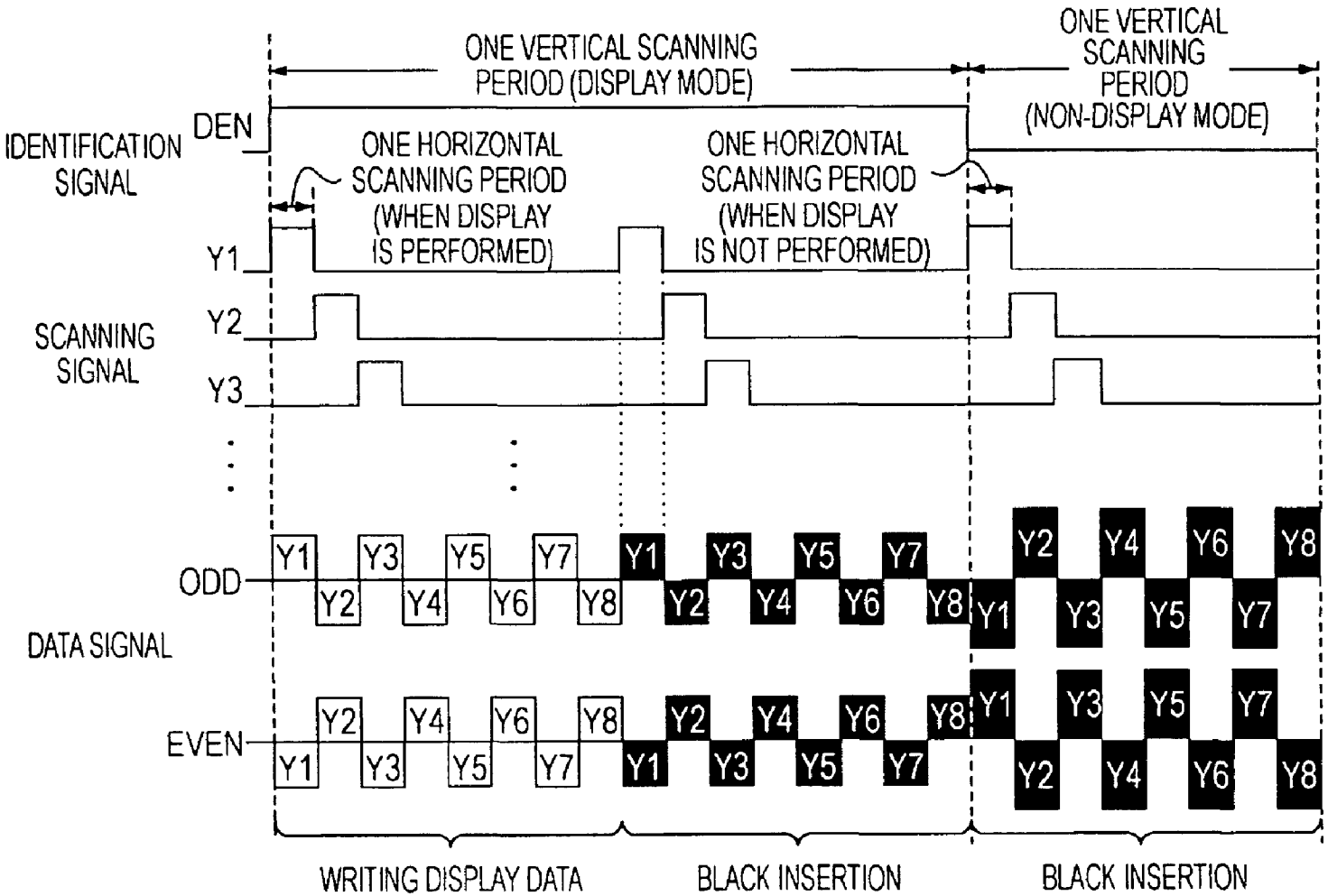
FIG. 3 is a waveform chart that illustrates a driving control of the liquid crystal device.

Next, a driving control of the liquid crystal device 700 in the display mode and in the non-display mode will be described. For easier description, the driving timing will be described with reference to FIG. 3 in which a black insertion pattern is simple. FIG. 3 is a view that shows a relationship among the identification signal DEN, the scanning signals Y1, Y2, Y3, . . . , and the data signals. In this embodiment, eight scanning lines Y1 to Y8 are described, and polarity inversion is performed every line. In addition, the data signals are driven so that odd-numbered (ODD) pixels and even-numbered (EVEN) pixels have alternate polarities and the polarities are inverted every frame. The identification signal DEN indicates a display mode when it is at a high level and indicates a non-display mode when it is at a low level.

As shown in the drawing, in the display mode, in the first half of one frame, display data are sequentially written every line in synchronization with the scanning signals (Y1 to Y8). After that, in the second half of the one frame, so-called black insertion is performed. That is, writing of black data as non-image data is sequentially performed in synchronization with each of the scanning signals (Y1 to Y8), thus preventing reverse transition. In the display mode, the thus writing of display data and writing of non-image data for preventing reverse transition are alternately performed.

As the identification signal DEN attains a low level, the mode is shifted from the display mode to the non-display mode. As shown in the drawing, in the non-display mode, writing of display data is not performed, but writing of black data for preventing reverse transition is performed only. In the present embodiment, at this time, the magnitude of a pulse voltage that indicates black data is made larger than that in the display mode. At this time, it is possible to set a voltage value that is larger than a voltage value corresponding to a black level. Note that the control may be performed to write display data even in the non-display mode; however, for easier description, an example in which writing of black data for preventing reverse transition is performed only is described.

In the present embodiment as described above, the reliability of maintaining the bend alignment is improved by increasing the magnitude of a pulse voltage in the display mode. At this time, even when light leakage occurs by applying a voltage value that is larger than a voltage value corresponding to a black level, the display characteristics are not adversely affected because of the non-display mode. In particular, when the control is performed to turn off the backlight 160 in the non-display mode, even when the transmittance ratio of the liquid crystal is increased because of an excessive voltage applied, light leakage hardly occurs and the reliability of maintaining the bend alignment is improved. Hence, the advantageous effect is remarkable.

In the above described embodiment, the data line driving circuit 120 switches a pulse voltage for black insertion in the display mode and in the non-display mode. However, the aspects of the invention are not limited to it. An auxiliary circuit may be provided to supply a voltage for black insertion in the non-display mode. That is, it may be configured so that the data line driving circuit 120 supplies a pulse voltage for black insertion in the display mode and, in the non-display mode, an auxiliary circuit that is separately provided from the data line driving circuit 120 supplies a pulse voltage for black insertion.

Figure 4:
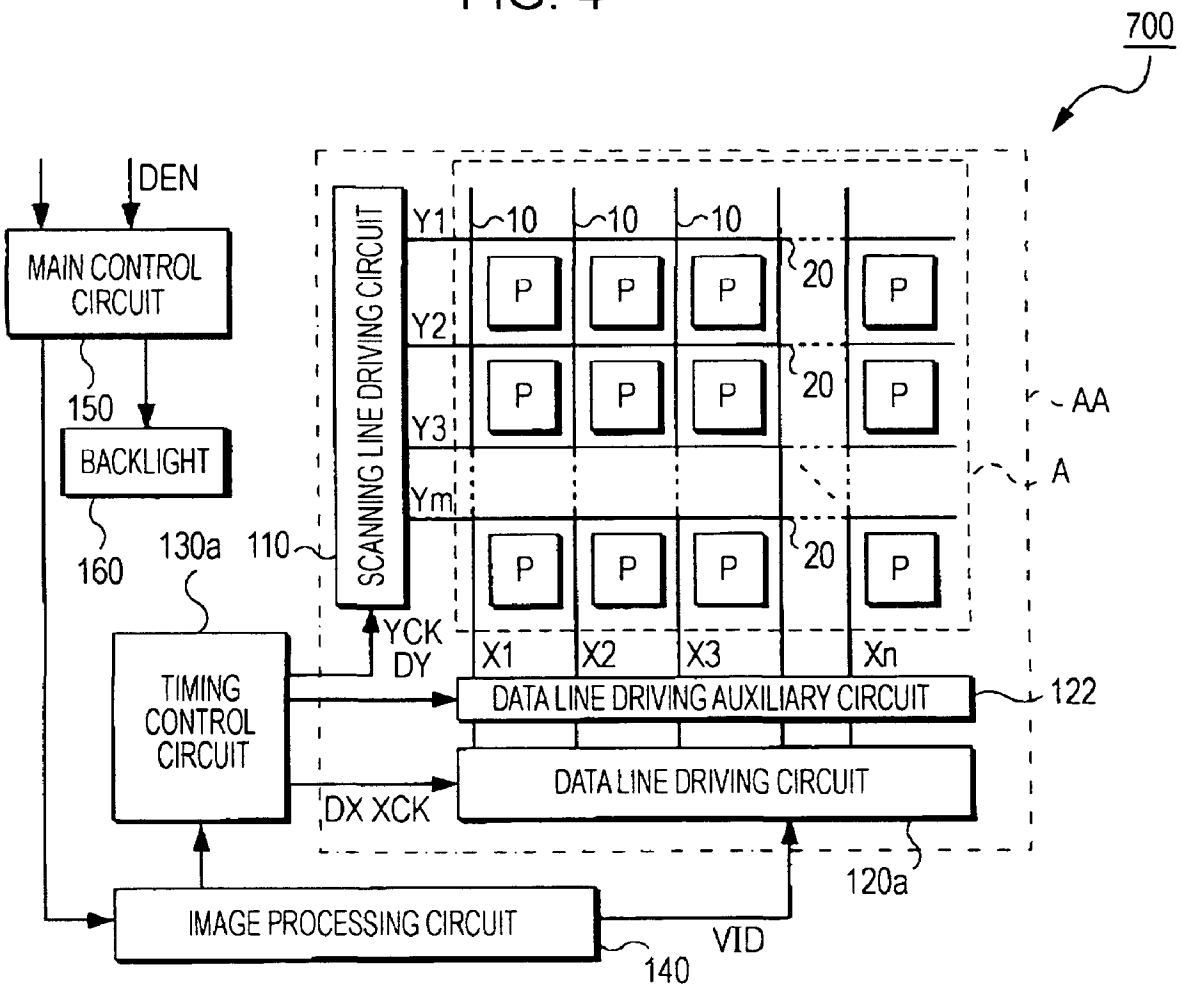
FIG. 4 is a block diagram of the liquid crystal device that is provided with an auxiliary circuit.

FIG. 4 is a block diagram of the liquid crystal device that is provided with a data line driving auxiliary circuit as an auxiliary circuit. The basic configuration is the same as that of the block diagram shown in FIG. 1, so that the same reference numerals are assigned to the same components, and the different portions will be specifically described. In this embodiment, in addition to a data line driving circuit 120*a* (main driving device) that drives the data lines 10 in the display mode, a data line driving auxiliary circuit 122 (auxiliary driving device) that supplies a voltage for black insertion in the non-display mode is provided. The data line driving auxiliary circuit 122 supplies the liquid crystal with a pulse voltage for black insertion in the non-display mode on the basis of the control performed by a timing control circuit 130*a*.

Figure 5:
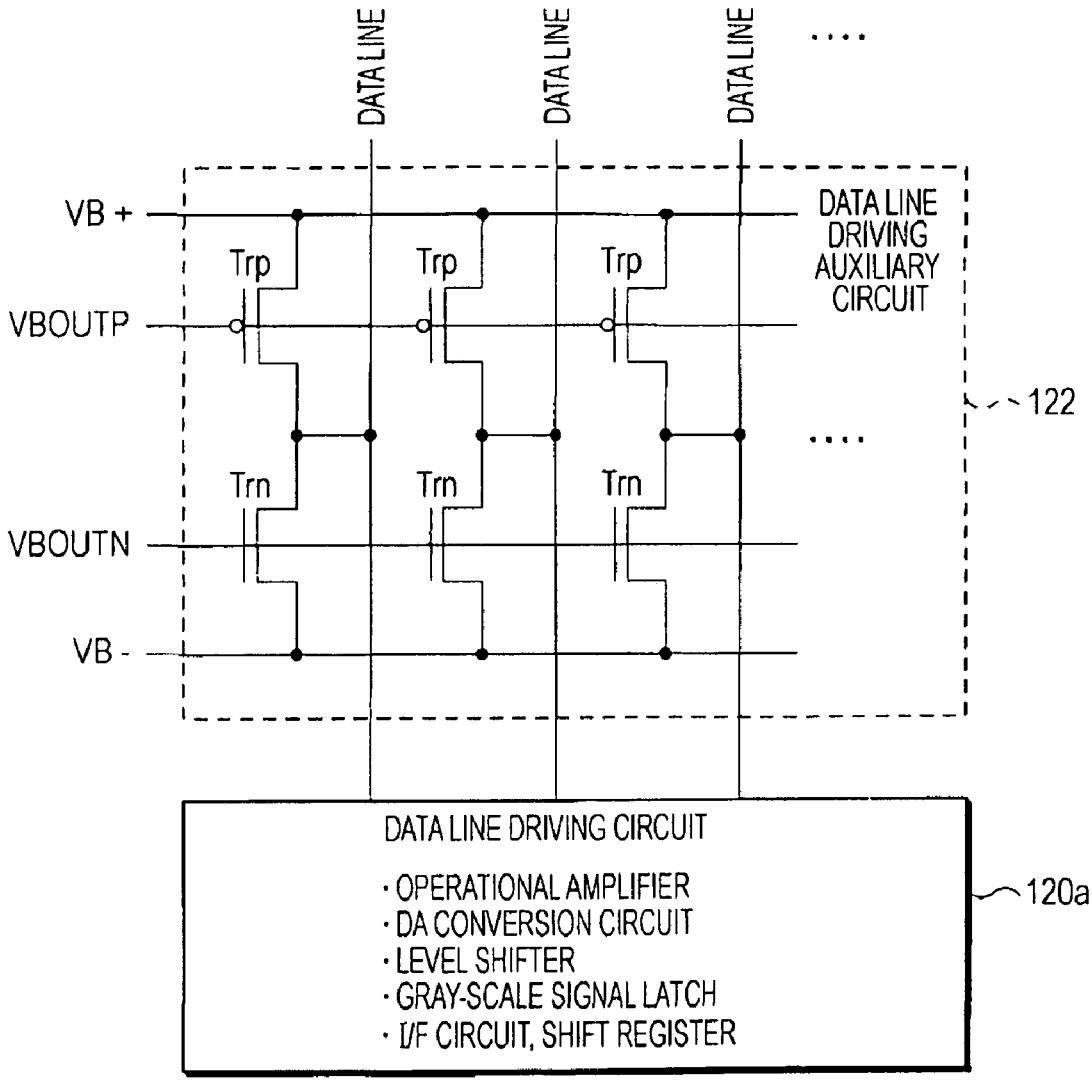
FIG. 5 is a block diagram that shows the configuration of a data line driving circuit and the configuration of a data line driving auxiliary circuit.

FIG. 5 is a block diagram that shows the configuration of the data line driving circuit 120*a* and the configuration of the data line driving auxiliary circuit 122. The data line driving circuit 120*a* includes an operational amplifier, a DA conversion circuit, a level shifter, a gray-scale signal latch, an IF circuit, a shift register, and the like. The data line driving auxiliary circuit 122 is supplied from a power supply (not shown) with voltages VB+ and VB− for black insertion in the non-display mode. In addition, a p-channel transistor Trp and an n-channel transistor Trn are connected in series between a node to which a voltage VB+ for black insertion is supplied and a node to which a voltage VB− for black insertion is supplied, and the connecting point therebetween is connected to the corresponding data line 10. Thus, when the transistor Trp is on and the transistor Trn is off, a voltage VB+ for black insertion is supplied to the corresponding data line 10. On the other hand, when the transistor Trp is off and the transistor Trn is on, a voltage VB− for black insertion is supplied to the corresponding data line 10. Moreover, when the transistor Trp is off and the transistor Trn is off, a data signal of the data line driving circuit 120*a* is supplied to the corresponding data line 10.

The on/off states of the transistor Trp and the transistor Trp are controlled by timing control signals VBOUTP and VBOUTN supplied from the timing control circuit 130*a*. Here, the magnitudes of voltages VB+ and VB− for black insertion in the non-display mode are larger than those of black insertion data in the display mode. Note that the embodiment shown in FIG. 5 may be applied to a frame inversion driving method or a horizontal line inversion driving method.

Figure 6:
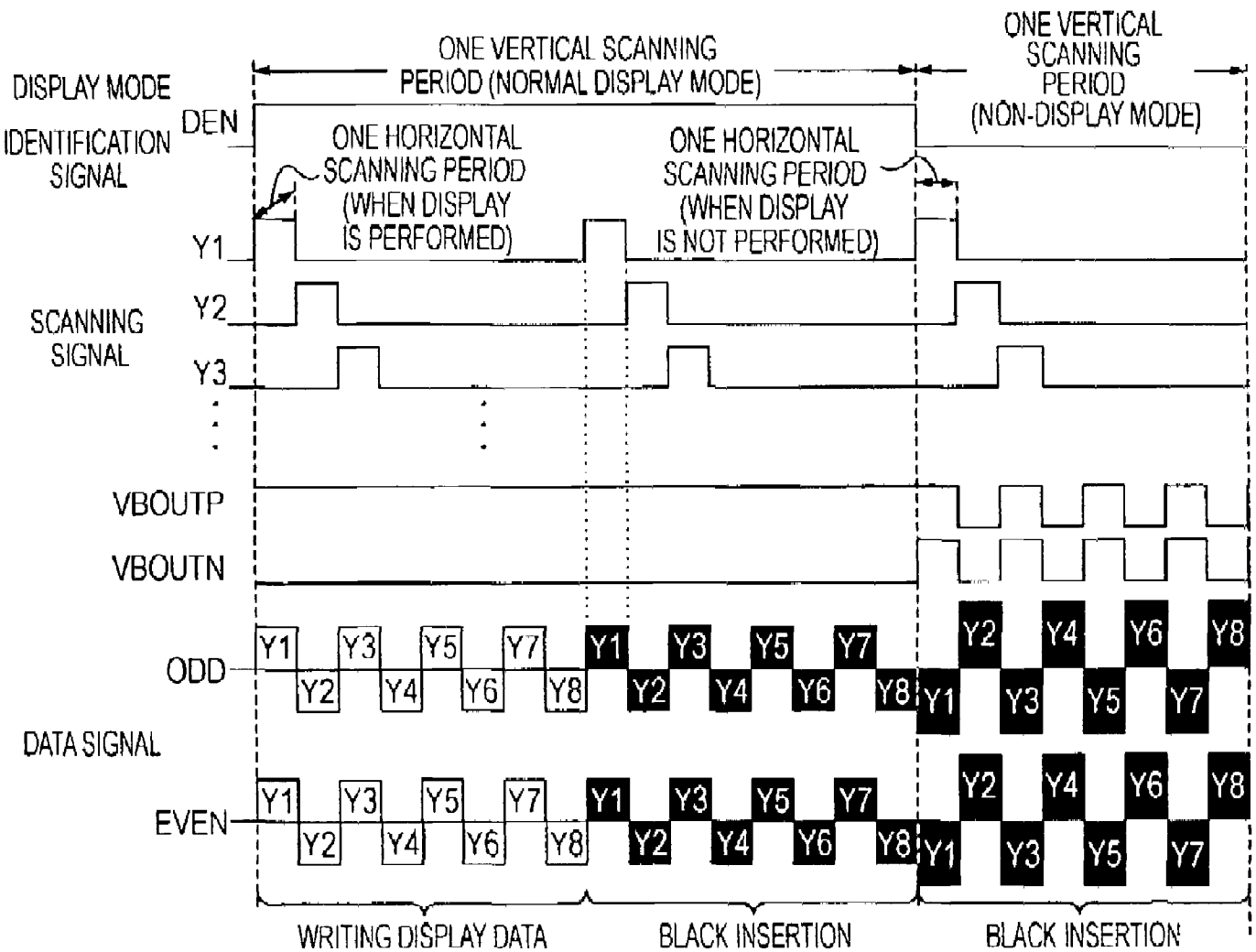
FIG. 6 is a waveform chart that illustrates a driving control of the liquid crystal device.

FIG. 6 is a waveform chart that illustrates a driving control of the liquid crystal device 700 in the display mode and in the non-display mode according to the present embodiment. As shown in the drawing, in the display mode, the timing control circuit 130*a* sets the VBOUTP to a high level and sets the VBOUTN to a low level. In this manner, because there is no output from the data line driving auxiliary circuit 122, a data signal output from the data line driving circuit 120*a* is supplied to the liquid crystal panel AA as it is.

On the other hand, when the mode is shifted to the non-display mode, the VBOUTP and the VBOUTN repeatedly output pulse signals respectively with the same polarity. This pulse signals synchronize with the scanning signals (Y1, Y2, Y3, . . . ). In addition, in the non-display mode, output from the data line driving circuit 120*a* is stopped, and electrical connection with the data line 10 is interrupted. For example, by making an output enable of the operational amplifier, provided at the output stage, inactive, the output terminal of the data line driving circuit 120*a* is made into a high impedance state.

As a result, the liquid crystal panel AA is applied with a pulse voltage of a magnitude VB that the data line driving auxiliary circuit 122 outputs as data for black insertion. Therefore, as in the case of the above embodiment, according to the present embodiment as well, it is possible to improve reliability of maintaining the bend alignment by increasing the magnitude of a pulse voltage in the non-display mode.

Furthermore, in the present embodiment, output from the data line driving circuit 120*a* may be stopped in the non-display mode. The data line driving circuit 120*a* includes components, such as the operational amplifier, DA conversion circuit, and the like, that steadily consumes electric current, while, on the other hand, because the data line driving auxiliary circuit 122 is formed of an inverter circuit, and the like, no steady current is produced. Thus, in the present embodiment, it is possible to reduce consumed electric current by stopping the operation of the data line driving circuit 120*a* that generates a steady current in the non-display mode.

In addition, because the magnitudes of voltages VB+ and VB− for black insertion in the non-display mode are larger than those of black insertion voltages in the display mode, as in the case of the above, it is necessary to design a voltage available for a wide range in the configuration in which both the voltages are output from the data line driving circuit 120. In this case, it is necessary to select a wide voltage range, that is, a circuit element having a high withstand voltage. Furthermore, because it is necessary to take into consideration that a normal operation is performed within a wide voltage range, degree of difficulty in design increases. These increase a burden on design and manufacturing and, hence, a cost increases. In contrast, in the second operation mode, when the data line driving auxiliary circuit 122 is separately provided, it is possible to reduce a withstand voltage of elements that constitute the data line driving circuit 120*a* as compared with a withstand voltage of elements that constitute the data line driving auxiliary circuit 122. In addition, because it is only necessary to perform a normal operation within a narrow voltage range, a burden on the design is reduced. As a result, it is possible to reduce the design cost and the manufacturing cost.

Figure 7:
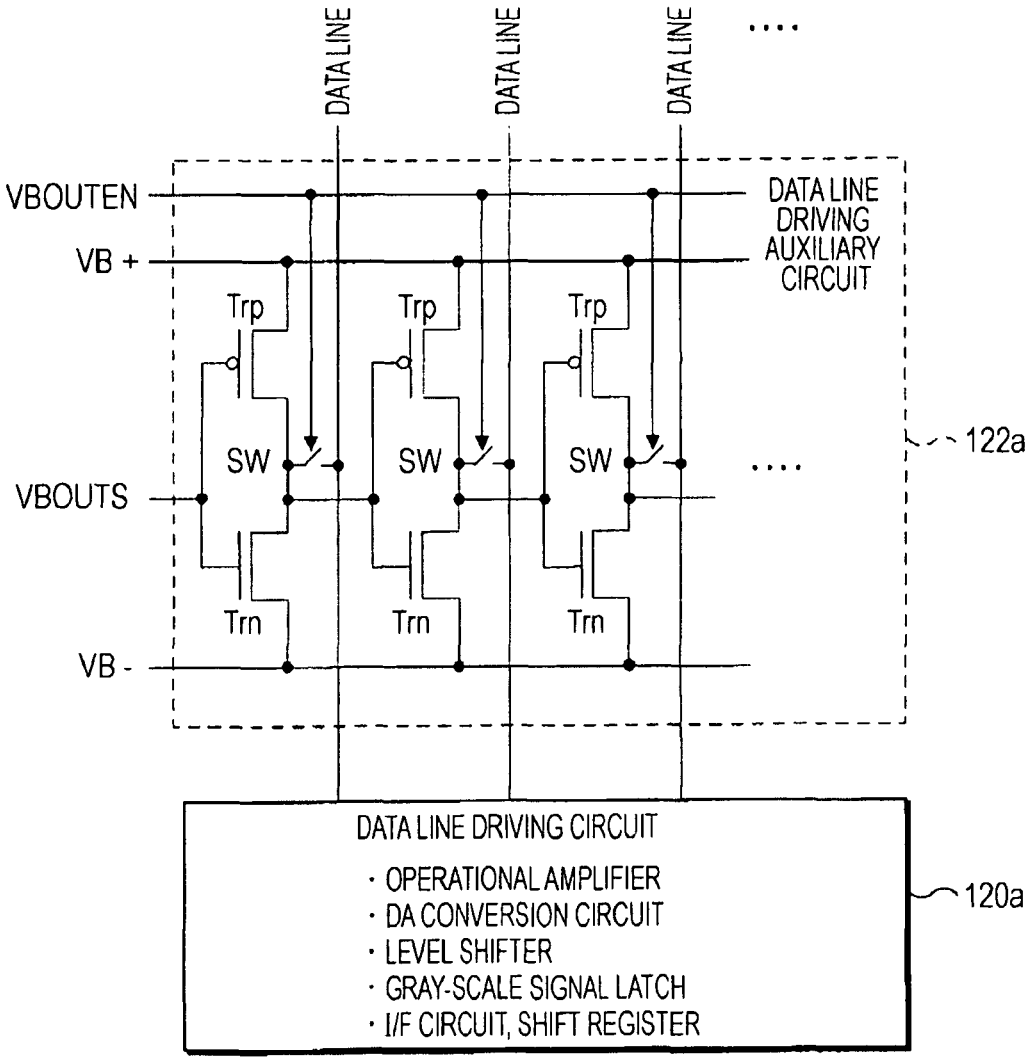
FIG. 7 is a block diagram that shows another embodiment of a data line driving circuit and a data line driving auxiliary circuit.

FIG. 7 is a block diagram that shows another embodiment of the data line driving auxiliary circuit 122*a*. The data line driving auxiliary circuit 122*a* is supplied from a power supply (not shown) with voltages VB+ and VB− for black insertion in the non-display mode. In addition, the transistor Trp and the transistor Trn are connected in series between a node to which a voltage VB+ for black insertion is supplied and a node to which a voltage VB− for black insertion is supplied to thereby form an inverter. Then, the inverters are connected in series with one another. For this reason, the polarity of output of the inverter that corresponds to any one of the odd-numbered data lines 10 is different from the polarity of output of the inverter that corresponds to any one of the even-numbered data lines 10.

In addition, a switch SW is provided between the output terminal of each inverter and the corresponding data line 10. By controlling the on/off of the switch SW, it is possible to select whether a data signal output from the data line driving circuit 120*a* is supplied to the data line 10 or the output of the inverter is supplied to the data line 10. In this embodiment, the switch SW enters an on state when a timing control signal VBOUTEN is at a high level, and the voltages VB+ or VB− for black insertion, which is the output of the inverter, is supplied to the data line 10.

In addition, the initial stage inverter is supplied with a timing control signal VBOUTS. When the timing control signal VBOUTS is at a high level, the voltage VB− for black insertion is output from the odd-numbered inverters and the voltage VB+ for black insertion is output from the even-numbered inverters. On the other hand, when the timing control signal VBOUTS is at a low level, the voltage VB+ for black insertion is output from the odd-numbered inverters and the voltage VB− for black insertion is output from the even-numbered inverters. Here, the magnitudes of voltages VB+ and VB− for black insertion in the non-display mode are larger than those of black insertion data in the display mode. Note that the embodiment shown in FIG. 7 may be applied to a dot inversion driving method or a vertical line inversion driving method.

Figure 8:
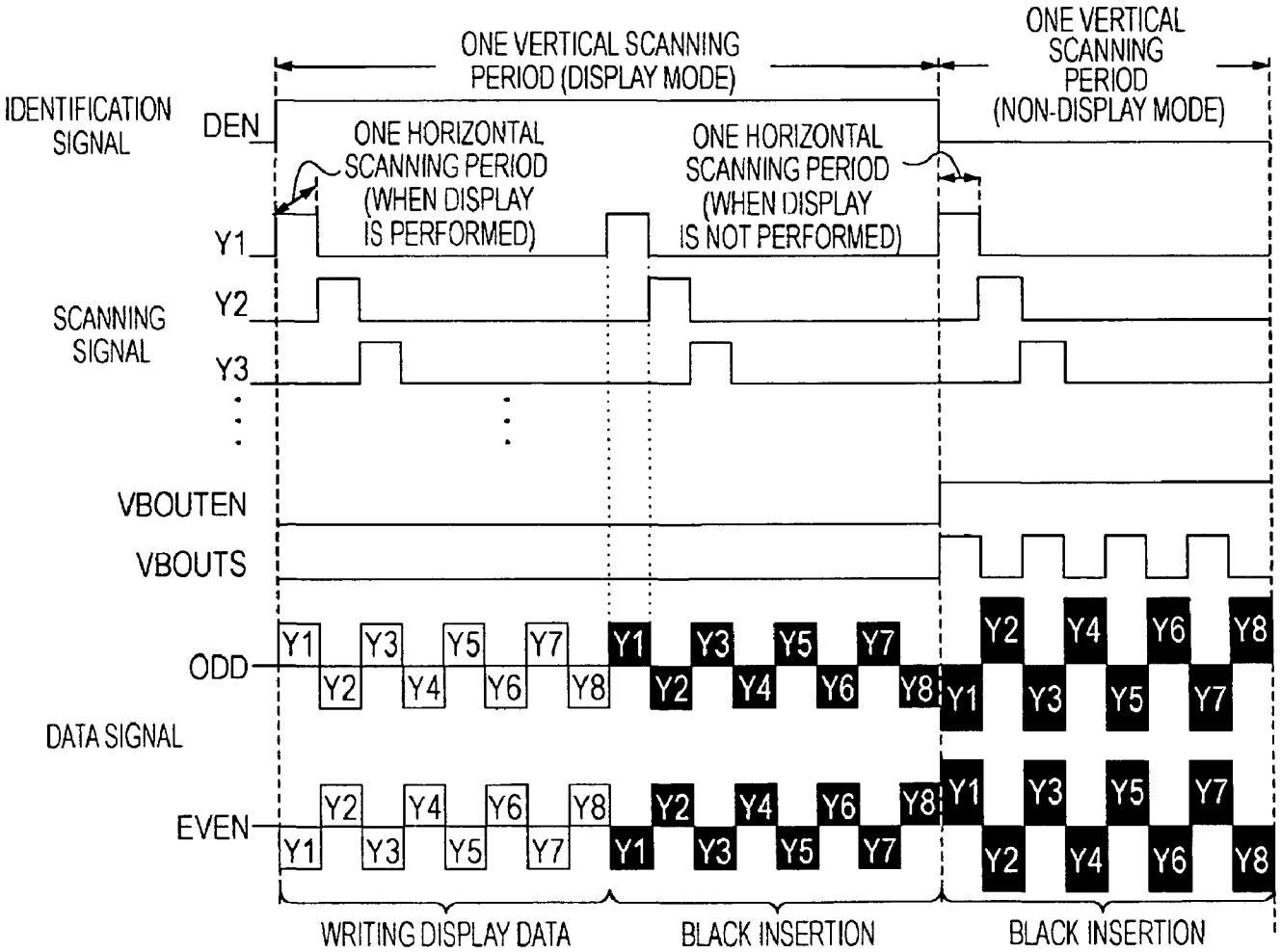
FIG. 8 is a waveform chart that illustrates a driving control of the liquid crystal device.

FIG. 8 is a waveform chart that illustrates a driving control of the liquid crystal device 700 in the display mode and in the non-display mode according to the present embodiment. As shown in the drawing, in the display mode, the timing control circuit 130*a* sets both the VBOUTEN and the VBOUTS to a low level. In this manner, because there is no output from the data line driving auxiliary circuit 122, a data signal output from the data line driving circuit 120*a* is supplied to the liquid crystal panel AA as it is.

On the other hand, when the mode is shifted to the non-display mode, the VBOUTEN enters an on state and the VBOUTS repeatedly outputs a pulse signal. This pulse signals synchronize with the scanning signals (Y1, Y2, Y3, . . . ). In addition, in the non-display mode, output from the data line driving circuit 120*a* is stopped, and electrical connection with the data line 10 is interrupted. For example, by making an output enable of the operational amplifier, provided at the output stage, inactive, the output terminal of the data line driving circuit 120*a* is made into a high impedance state.

As a result, the liquid crystal panel AA is applied with a pulse voltage of a magnitude VB that the data line driving auxiliary circuit 122*a* outputs as data for black insertion. Therefore, as in the case of the above embodiment, according to the present embodiment as well, it is possible to improve reliability of maintaining the bend alignment by increasing the magnitude of a pulse voltage in the non-display mode. Furthermore, in the present embodiment, output from the data line driving circuit 120*a* may be stopped in the non-display mode. The data line driving circuit 120*a* includes components, such as the operational amplifier, DA conversion circuit, and the like, that steadily consumes electric current, while, on the other hand, because the data line driving auxiliary circuit 122 is formed of an inverter circuit, and the like, no steady current is produced. Thus, in the present embodiment, it is possible to reduce consumed electric current by stopping the circuit that generates a steady current in the non-display mode. Note that it may be configured so that a voltage for black insertion is output from the data line driving auxiliary circuit not only in the non-display mode but also in the display mode. In this case, it is possible to stop the operation of the data line driving circuit when black insertion is performed in the display mode, so that it is possible to further reduce electric current consumption.

2. Electronic Apparatuses

Figure 9:
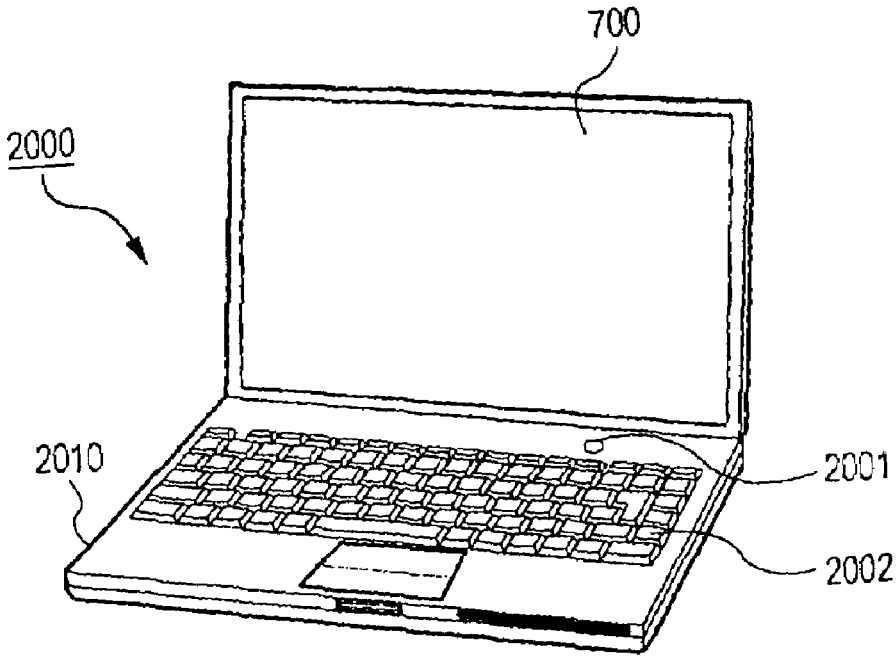
FIG. 9 is a perspective view of a personal computer, which is one example of an electronic apparatus.

Next, electronic apparatuses that use the liquid crystal device 700 according to the aspects of the invention will be described. FIG. 9 is a perspective view that shows a configuration of a mobile personal computer that uses the liquid crystal device 700 as a display device according to any one of the embodiments described above. The personal computer 2000 includes the liquid crystal device 700, which serves as a display device, and a main body portion 2010. The main body portion 2010 is provided with a power switch 2001 and a keyboard 2002. The personal computer 2000 is shifted to a non-display mode, when not receiving any operation for a predetermined period of time, when the cover portion that accommodates the liquid crystal device 700 is closed, or the like.

Figure 10:
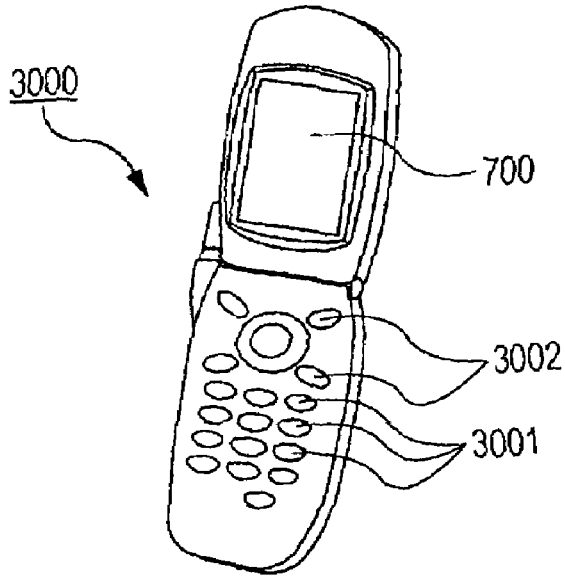
FIG. 10 is a perspective view of a cellular phone, which is one example of an electronic apparatus.

FIG. 10 is a view that shows a configuration of a cellular phone that uses the liquid crystal device 700 according to the embodiment. The cellular phone 3000 includes a plurality of operation buttons 3001, a plurality of scroll buttons 3002, and the liquid crystal device 700, which serves as a display device. By manipulating the scroll buttons 3002, a screen displayed on the liquid crystal device 700 will be scrolled. The cellular phone 3000 is shifted to a non-display mode, when not receiving any operation for a predetermined period of time, when the folding body is closed, or the like.

Figure 11:
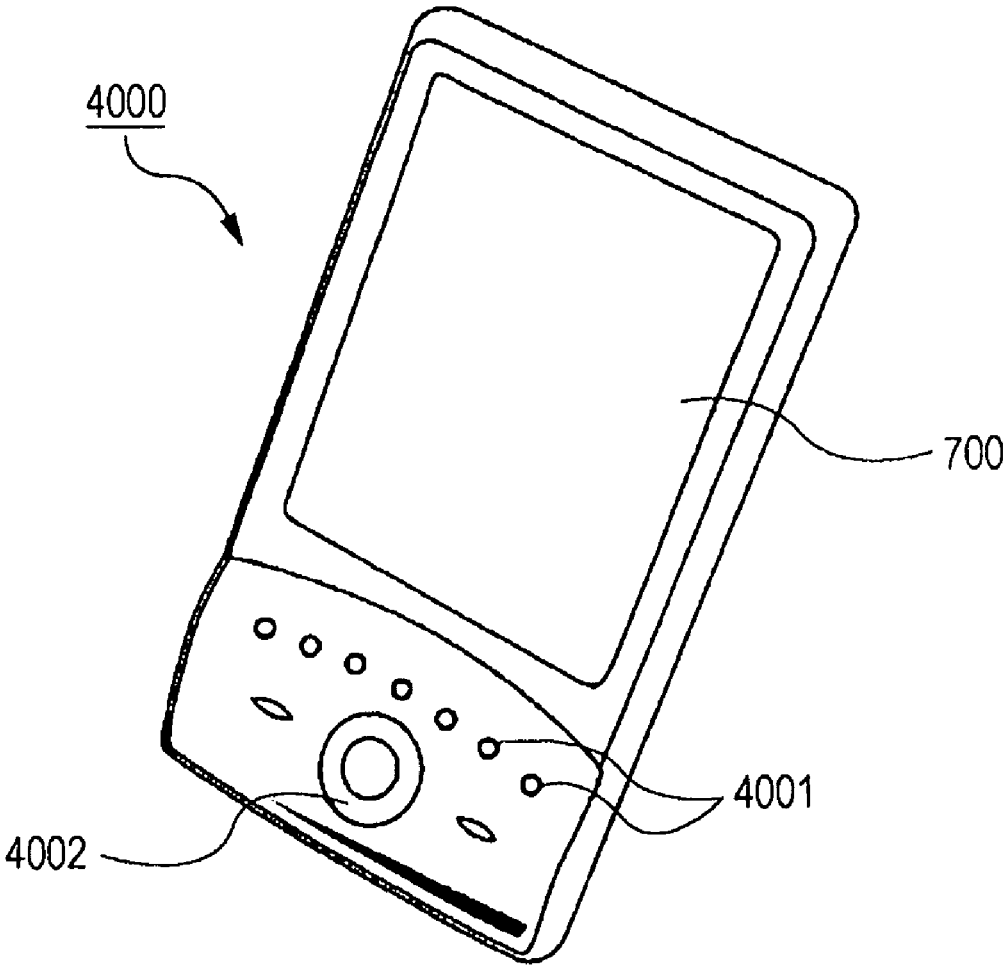
FIG. 11 is a perspective view of a personal digital assistants, which is one example of an electronic apparatus.

FIG. 11 is a view that shows a configuration of a personal digital assistants (PDA) that uses the liquid crystal device 700 according to the embodiment. The personal digital assistants 4000 includes a plurality of operation buttons 4001, a power switch 4002, and the liquid crystal device 700, which serves as a display device. As the power switch 4002 is manipulated, various pieces of information, such as an address book and a schedule book, are displayed on the liquid crystal device 700. The personal digital assistants 4000 is shifted to a non-display mode, when not receiving any operation for a predetermined period of time, or the like.

Note that the electronic apparatuses that employ the liquid crystal device according to the aspects of the invention include, in addition to the apparatuses shown in FIG. 9 to FIG. 11, a projector, a television, a video camera, a car navigation system, a pager, an electronic personal organizer, an electronic paper, an electronic calculator, a word processor, a workstation, a video telephone, a POS terminal, a printer, a scanner, a photocopier, a video player, and a device provided with a touch panel.

The entire disclosure of Japanese Patent Application No. 2007-080863, filed Mar. 27, 2007 is expressly incorporated by reference herein.

What is claimed is:

1. A liquid crystal device that operates in a first operation mode and a second operation mode, comprising:

a plurality of scanning lines;

a plurality of data lines;

a plurality of pixel circuits that are provided at positions corresponding to intersections of the scanning line and the data lines, wherein each of the plurality of pixel circuits includes a liquid crystal element that has a first electrode, a second electrode, and a liquid crystal held between the first electrode and the second electrode, wherein a first alignment, which is an initial state, and a second alignment for display are provided for the liquid crystal as an alignment state;

a scanning line driving device that selects the plurality of scanning lines in a predetermined order; and a data line driving device that supplies each of the pixel circuits corresponding to the selected one of scanning lines with a writing voltage through the corresponding data line, wherein in the first operation mode, in one frame that includes a first period and a second period, the data line driving device outputs a gray-scale voltage corresponding to a gray-scale to be displayed as the writing voltage in the first period and outputs a first voltage, which is used for maintaining the second alignment, as the writing voltage to the data line in the second period, wherein in the second operation mode, the data line driving device outputs a second voltage, which is used for maintaining the second alignment, as the writing voltage in all the period of the one frame, and wherein the second voltage is higher than the first voltage.

2. The liquid crystal device according to claim 1, wherein the liquid crystal is an OCB (Optical Compensated Bend) mode liquid crystal, wherein the first alignment is a splay alignment, and wherein the second alignment is a bend alignment.

3. The liquid crystal device according to claim 1, further comprising:

a backlight that turns on a light in the first operation mode and that turns off a light in the second operation mode.

4. The liquid crystal device according to claim 1, wherein the data line driving device includes:

a main driving device that supplies the data line with the gray-scale voltage as the writing voltage in the first operation mode; and an auxiliary driving device that supplies the data line with the second voltage as the writing voltage in the second operation mode.

5. The liquid crystal device according to claim 4, wherein the main driving device is configured to stop operating in the second operation mode.

6. The liquid crystal device according to claim 1, wherein the data line driving device includes:

a main driving device that supplies the data line with the gray-scale voltage and the first voltage as the writing voltage in the first operation mode; and an auxiliary driving device that supplies the data line with the second voltage as the writing voltage in the second operation mode.

7. The liquid crystal device according to claim 1, wherein the first operation mode is a display mode in which an image is displayed, and wherein the second operation mode is a non-display mode in which no image is displayed.

8. An electronic apparatus comprising the liquid crystal device according to claim 1.

9. A method of driving a liquid crystal device in a first operation mode and in a second operation mode, wherein the liquid crystal device includes a plurality of scanning lines, a plurality of data lines, and a plurality of pixel circuits, wherein the plurality of pixel circuits are provided at positions corresponding to intersections of the scanning line and the data lines, wherein each of the plurality of pixel circuits includes a liquid crystal element that has a first electrode, a second electrode, and a liquid crystal held between the first electrode and the second electrode, wherein a first alignment, which is an initial state, and a second alignment for display are provided for the liquid crystal as an alignment state, comprising:

selecting the plurality of scanning lines in a predetermined order;

supplying each of the pixel circuits corresponding to a selected one of the scanning lines with a writing voltage through the corresponding data line;

in the first operation mode, outputting, in one frame that includes a first period and a second period, a gray-scale voltage corresponding to a gray-scale to be displayed as the writing voltage in the first period and outputting a first voltage, which is used for maintaining the second alignment, as the writing voltage to the data line in the second period;

in the second operation mode, outputting a second voltage, which is used for maintaining the second alignment, as the writing voltage to the data line in all the period of the one frame; and setting the second voltage to be higher than the first voltage.

10. The method of driving the liquid crystal device according to claim 9, wherein the first operation mode is a display mode in which an image is displayed, and wherein the second operation mode is a non-display mode in which no image is displayed.

* * * * *